US005554202A

United States Patent [19]

Brooker et al.

[11] Patent Number: 5,554,202

[45] Date of Patent: Sep. 10, 1996

[54] GASIFIER MONITORING APPARATUS

[75] Inventors: Donald D. Brooker, Hopewell Junction, N.Y.; James S. Falsetti, New Fairfield, Conn.; James K. Wolfenbarger, Torrance, Calif.; Dinh-Cuong Vuong, Nederland; Allen J. Pertuit, Sugar Land, both of Tex.

[73] Assignee: Texaco Inc., White Plains, N.Y.

[21] Appl. No.: 407,220

[22] Filed: Mar. 21, 1995

Related U.S. Application Data

[63] Continuation of Ser. No. 114,856, Sep. 2, 1993, abandoned.

[51] Int. Cl.[6] ..... C10J 3/48; C10J 3/52

[52] U.S. Cl. ..... 48/62 R; 48/69; 48/77; 48/87; 48/DIG. 2; 422/111

[58] Field of Search ..... 48/DIG. 2, 62 R, 48/DIG. 10, 69, 77, 87; 266/78, 99; 73/781, 786, 862.541; 422/119, 111.108, 105; 110/185, 187

[56] References Cited

U.S. PATENT DOCUMENTS

| | | | |
|---|---|---|---|
| 2,546,155 | 3/1951 | Haber et al. | 73/781 |
| 3,850,416 | 11/1974 | Jackson | 266/97 |
| 4,004,647 | 1/1977 | Forst | 73/862.541 |
| 4,073,627 | 2/1978 | Anderson | 48/DIG. 2 |
| 4,136,556 | 1/1979 | Graham | 73/781 |
| 4,331,450 | 5/1982 | Elliott | 48/DIG. 2 |
| 4,474,582 | 10/1984 | Dille et al. | 48/DIG. 10 |
| 4,511,371 | 4/1985 | Blaskowski | 48/DIG. 2 |
| 4,525,176 | 6/1985 | Koog et al. | 48/DIG. 2 |
| 4,750,435 | 6/1988 | Mayes | 48/DIG. 2 |
| 4,788,483 | 10/1988 | Martin et al. | 48/DIG. 2 |
| 4,988,368 | 1/1991 | Crenwelge et al. | 48/DIG. 2 |
| 5,087,271 | 2/1992 | Stellaccio | 48/DIG. 10 |
| 5,112,366 | 5/1992 | Liu | 48/DIG. 2 |
| 5,136,808 | 8/1992 | Caldera | 48/DIG. 2 |
| 5,281,243 | 1/1994 | Leininger | 48/197 R |

FOREIGN PATENT DOCUMENTS

| | | | |
|---|---|---|---|
| 2215620 | 10/1973 | Germany | 73/862.541 |

*Primary Examiner*—Peter Kratz
*Attorney, Agent, or Firm*—Kenneth R. Priem; Richard A. Morgan

[57] ABSTRACT

Method and apparatus for deslagging a gasifier's combustion chamber which has accumulated a residual solidified slag as a result of the fuel being combusted. The gasifier is provided with means for liquefying the slag into a flowable state by heating the combustion chamber to a temperature of which the slag will flow. To epitomize the gasifiers' deslagging mode, the combustion chamber is provided with an array of strain monitoring or measuring load cells which are located to detect and collectively respond to movement at the combustion chamber floor whereby to control the slag removing procedure.

10 Claims, 3 Drawing Sheets

SECTION AA

GASIFIER MONITORING APPARATUS

This is a continuation of application Ser. No. 08/114,856 filed Sep. 2, 1993 now abandoned.

BACKGROUND OF THE INVENTION

1. Field of the Invention

The production of a synthesis gas in the normal gasifier usually embodies the partial oxidation of a fuel mixture at a relatively high temperature. The resulting products, when the fuel includes a solid carbonaceous ingredient such as ground coal or coke, will include the desired synthesis gas, together with an amount of uncombusted effluent.

-When the fuel mixture is comprised as noted of a carbonaceous material, such as coal or coke, the composition of the latter can be such that varying amounts will remain uncombusted and will consequently be passed through the gasifier or circulated in the combustion chamber and remain a solid. While a considerable amount of the solid component will be carried into the gasifier's quench chamber, at least a portion will be retained, and cling to the combustion chamber walls where it forms a slag.

When in a plastic state, the slag will gradually flow by gravity down the gasifier combustion chamber walls to the water bath; it will, however, eventually solidify at such time as the unit is closed down or the temperature of the combustion chamber is reduced below the slag melting point.

At some point in the syngas production process, it will be apparent that the presence of an excessive amount of slag within the gasifier is impeding or will impede the gasification process. Prudent and economic practice dictates that at this point, the unit be shut down for the specific purpose of removing the slag. This is achieved by a melting or a deslagging operation, which embodies adjusting the gasifier to a sufficiently high temperature to melt the slag, and/or adding an oxidizer.

2. Discussion of the Prior Art

Processes applicable to the deslagging of gasifiers as a practical matter usually embody the primary step of heating the combustion chamber sufficiently to convert hardened or solidifed slag into flowable condition. An illustration of such a process is disclosed in U.S. Pat. No. 4,525,176, Kogg, et al. The claimed deslagging process is carried out by introduction of a variable fuel mixture into a gasifier combustion chamber where slag has accumulated. A deslagging burner is physically adjustable in the combustion chamber to improve the distribution of heat.

In simple terms, the deslagging operation or phase consists of injecting a combustible gas or liquid fuel mixture into the gasifier combustion chamber from either a burner particularly adapted to the purpose or from the process burner. The flow of fuel gas or gas mixture is normally monitored to assure a high enough temperature and oxygen partial pressure that the slag will be effectively fluidized and flow from the combustion chamber. The combustion chamber walls will then be substantially free of slag which could otherwise impede continuation of the syngas manufacturing process. It is found to be desirable through practice, however, that rather than completely removing all slag, a minor amount can be retained on the combustion chamber walls as a corrosion preventive or inhibiting measure for the refractory lining.

A burner of the type utilized in a deslagging operation may differ from the normal syngas process burner. Further, the flow of gas or liquid from the deslagging burner into the combustion chamber is preferably metered such that the most effective fuel mixture is formed and enters the combustion chamber to be immediately ignited and to eventually raise the chamber to a desired temperature level and oxygen partial pressure.

SUMMARY OF THE INVENTION

To maximize the treatment of gasifier slag, particularly its presence and its subsequent removal from the gasifiers' combustion chamber, the latter is provided with means for monitoring the weight of the slag as it accumulates and subsequently as it flows from the combustion chamber during a deslagging operation. To this end, the gasifier is provided with means for monitoring and determining on a continuous basis the gross weight of the combustion chamber with slag, and thereafter, calculating the amount of slag which had been removed as a result of the deslagging process. The resulting data, when fed into a preprogrammed computer will cause the fuel composition, and its rate of feed to be automatically adjusted to comply with the computer program.

DESCRIPTION OF THE INVENTION

Figure 1:
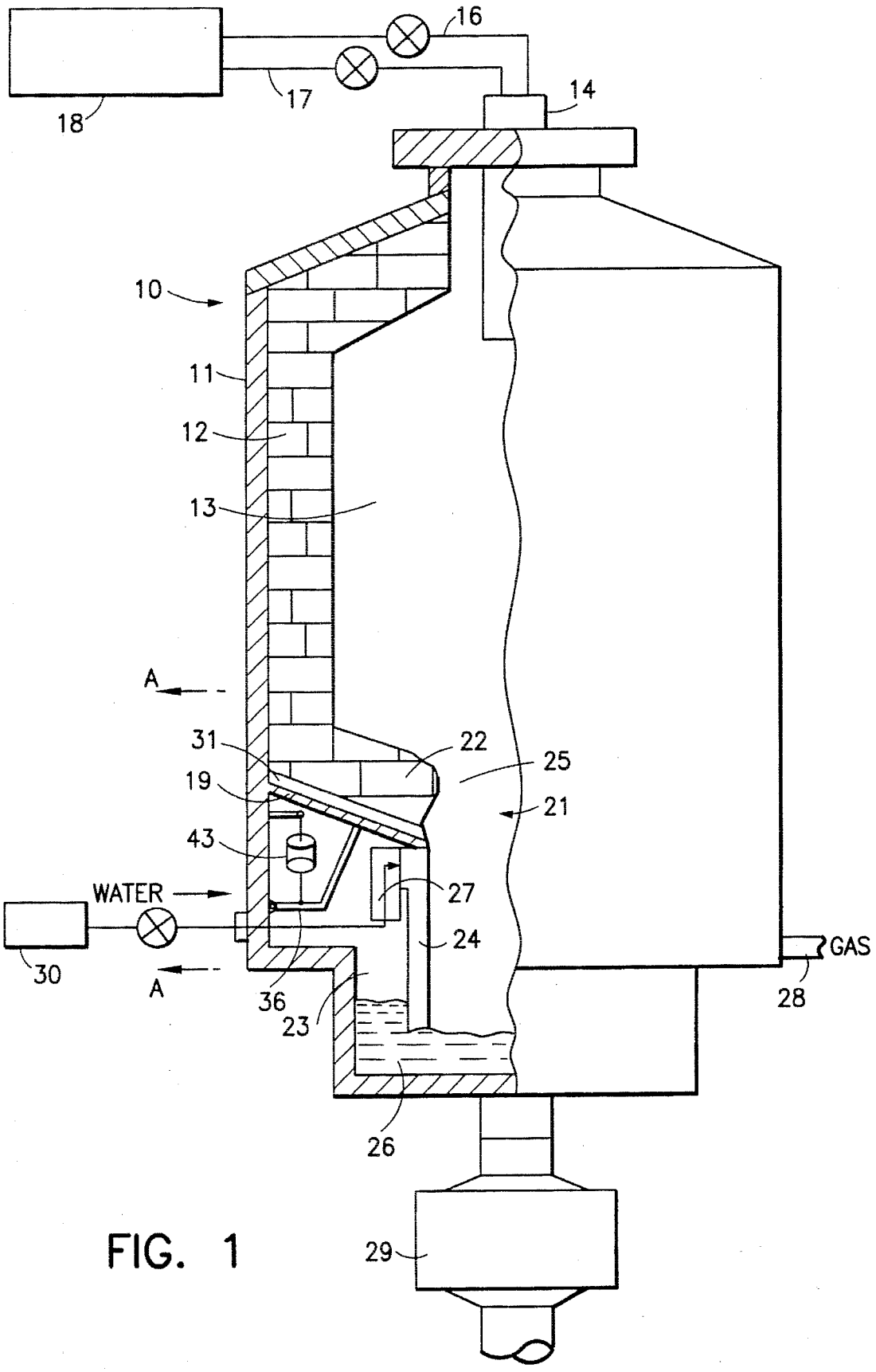
FIG. 1 is an elevated view in partial cross section of a gasifier of the type contemplated.

Referring to FIG. 1, a gasifier 10 of the type contemplated is shown, which is comprised essentially of an elongated upright shell 11 having a refractory lining 12 formed of fire brick or the like, which defines a combustion chamber 13 in which the partial combustion of a fuel mixture takes place. The term fire brick as used hereinafter is meant to include the various forms and grades of refractory materials commercially available to this purpose The upper end of gasifier 10 includes an opening which positions a deslagging burner 14. In one embodiment of fuel feed, burner 14 is communicated through one or more valved conduits such as 16 & 17 to a pressurized source 18 of a fuel mixture. For deslagging purposes, burner 14 can be designed to mix two or more gases such as propane and air or oxygen to achieve controlled melting of the solidified slag through. The lower end of gasifier shell 11 includes a floor 19 characterized by a generally conical shape to direct downward flowing hot products of combustion, as well as the solid flowable effluent, into a constricted throat opening 25 of a throat section 21. Floor 19 constitutes a continuation of shell 11 sidewall to which it is welded, and is likewise provided with a refractory layer 22 to withstand the combustion chamber conditions which can achieve an operating temperature of approximately 2,500° F.

The function of the constricted throat opening 25 is to guide downflowing hot gases into a quench chamber 23 where both the gases and solid effluent will be quenched prior to discharge. Quench chamber 23 includes a dip tube 24 which is spaced below the constricted throat opening 25, and which guides downward flowing gas and solids into water bath 26 (FIG. 1).

Dip tube 24 is further provided with a quench ring 27 which serves the purpose of injecting coolant water from an external pressurized source 30 against the walls of dip tube 24 to cool and protect them from contact with the excessively high temperature products of combustion.

After the quenching step, cooled synthesis gas, which may continue to carry a minor amount of particulate material, is discharged from the gasifier by outlet 28 into one or more heat exchangers or coolers for further processing. The solid materials, which enter water bath 26 gravitate through the bath and are passed into a lock hopper 29 which is periodically evacuated to dispose of this solid waste matter.

Figure 2:
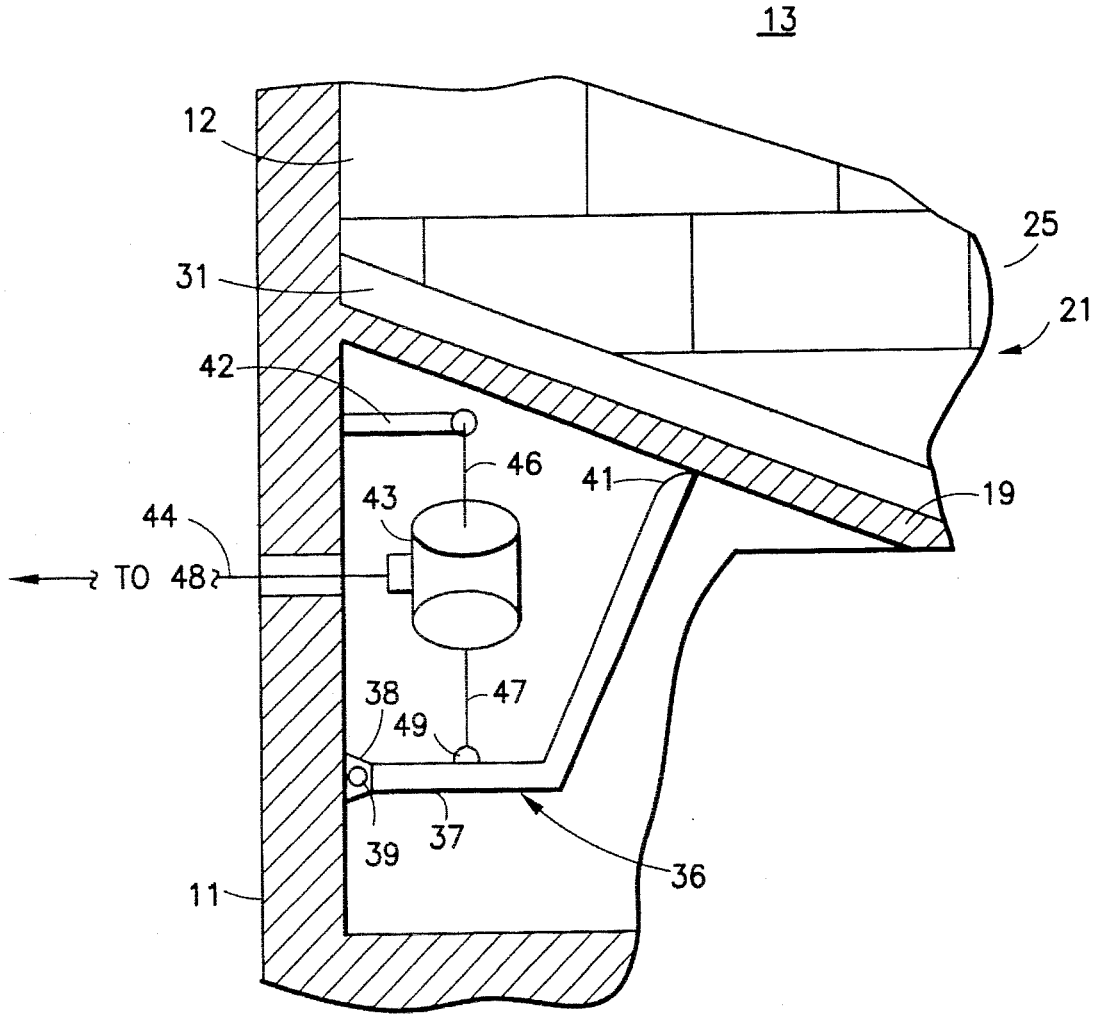
FIG. 2 is a segmentary view of the apparatus shown in FIG. 1.

Referring to FIG. 2, throat section 21 of the gasifier is essentially a continuation of the gasifier floor refractory liner 22. It is thus formed basically of a refractory material capable of withstanding the combustion chamber's high process temperature. It will also withstand the adverse effects of flowing slag which normally runs from the combustion chamber walls and floor into bath 26.

Floor 19 is preferably formed of a high grade steel of sufficient thickness to withstand the sustained heat of combustion within chamber 13 as well as to support the weight of the refractory material which covers the combustion chamber's walls and floor. As shown, the refractory layer 12 is comprised in a preferred form of several layers of refractory which are positioned on a support shelf 31. Shelf 31 is fastened to floor 19 preferably by being welded in place.

Structurally, floor 19 will support the refractory lining 12 during all periods of the gasifier operation. It will, however, deflect downwardly under the combined weight of the refractory layers, and the effects of heat, as well as the presence of slag which forms and which collects on the combustion chamber surfaces. It has been experienced under operating conditions that the slag which accumulates in a gasifier over a prolonged period of operation can be in excess of 20 to 25 tons, depending on the size of the unit.

The downward deflection of floor 19 under operating conditions, even though minimal, will indicate not only the weight of the wall and floor refractory materials, but will also reflect the weight of slag which has been formed and which remains in combustion chamber 13 during the gas producing phase.

The downward deflection of floor 19 may not necessarily be uniform at all points. It can however, be accurately measured through a monitoring system which is capable of detecting aggregate downward displacement, and the subsequent return of the floor to its position under reduced or no slag conditions.

The present system for a floor deflection monitoring means is comprised in general of a series of strain measuring or determining gauges. These members are spaced peripherally about the quench chamber, preferably four in number being equally spaced from the gasifier central axis.

Thus, monitoring will be constant as floor 19 deflects downwardly during a gas producing operation when slag accumulates, and as it retracts upwardly during a subsequent deslagging operation. The monitor system is arranged such that a composite estimating of the floor's overall displacement can be established. The resulting deflection data, when fed from each strain measuring load cell into a computer or the like, will provide a continuous, yet instantaneous reading of the total weight of the combustion chamber together with slag accumulation. If the overall weight of combustion chamber 13 set as a baseline prior to the slag deposition, and which factor is programmed into the computer, the weight of the slag is available at any time.

The computer output can take the form of a visual readout on a screen, preferably said output is internally programmed to automatically control fuel composition and rate of fuel gas feed to burner 14. These automatic adjustments will in effect comply with the programmed control procedure of the gasifier's deslagging phase rather than relying on an assumed slag flow. When a syngas producing facility is comprised of more than one gasifier, each can be programmed to automatically switch operations between the producing phase and the deslagging phase. The advantage of such an arrangement resides in the continuity of synthetic gas production. The gas producing and deslagging phases of each unit is conducted with the other so that gas production on the aggregate will be uninterrupted.

Referring to FIG. 2, in one embodiment, the gasifier floor displacement monitoring system is comprised of a plurality of monitoring units spaced equally about the quench chamber 23 (FIG. 1). Each said unit referred to hereinafter as a load cell apparatus is comprised of an elongated sensing arm 36 having an outer end 37 fastened to a fixed stationary point such as the inner wall of gasifier shell 11. Arm 36 is pivotally positioned by a bracket 38 having a hinge pin 39, which allows pivotal vertical movement of the sensing arm about pin 39.

The remote or movement sensing end of arm 36 is provided with a tip 41 which is maintained in sliding engagement with the lower or under surface of floor 19. Arm 36 is maintained in contact with floor 19 under side regardless of the displaced position of the latter. An inwardly extending second or stationary support arm 42 is fixedly positioned against the gasifier shell 11 wall directly above sensing arm 36.

One form of monitoring gauge or instrument 43 adapted to the present purpose can be such as a form of strain gauge or load cell 43, a commercial example of which is identified as High Temperature Load Cell TH-CTI manufactured by the Eagle Microsystems Corporation of Chester Springs, Pa. Load Cell 43 includes a first actuating element 46 arranged in supported relationship to the remote end of stationary arm 42. At least one other actuating element 47 is engaged at a second pivot point 49 to sensing arm 36.

Functionally, as floor 19 is caused to deflect either upwardly or downwardly, sensing arm 36 will follow such movement at tip 41 and reflect said movement in the form of a generated signal. Each deflecting load cell 43 is provided with means such as a shielded cable 44 which sealably transverses the wall of shell 11 for transmitting the resulting electronic signal data to a computer or analyzer 48. The latter as noted will receive comparable data from each of the respective load cells 43 spaced about the quench chamber.

Figure 3:
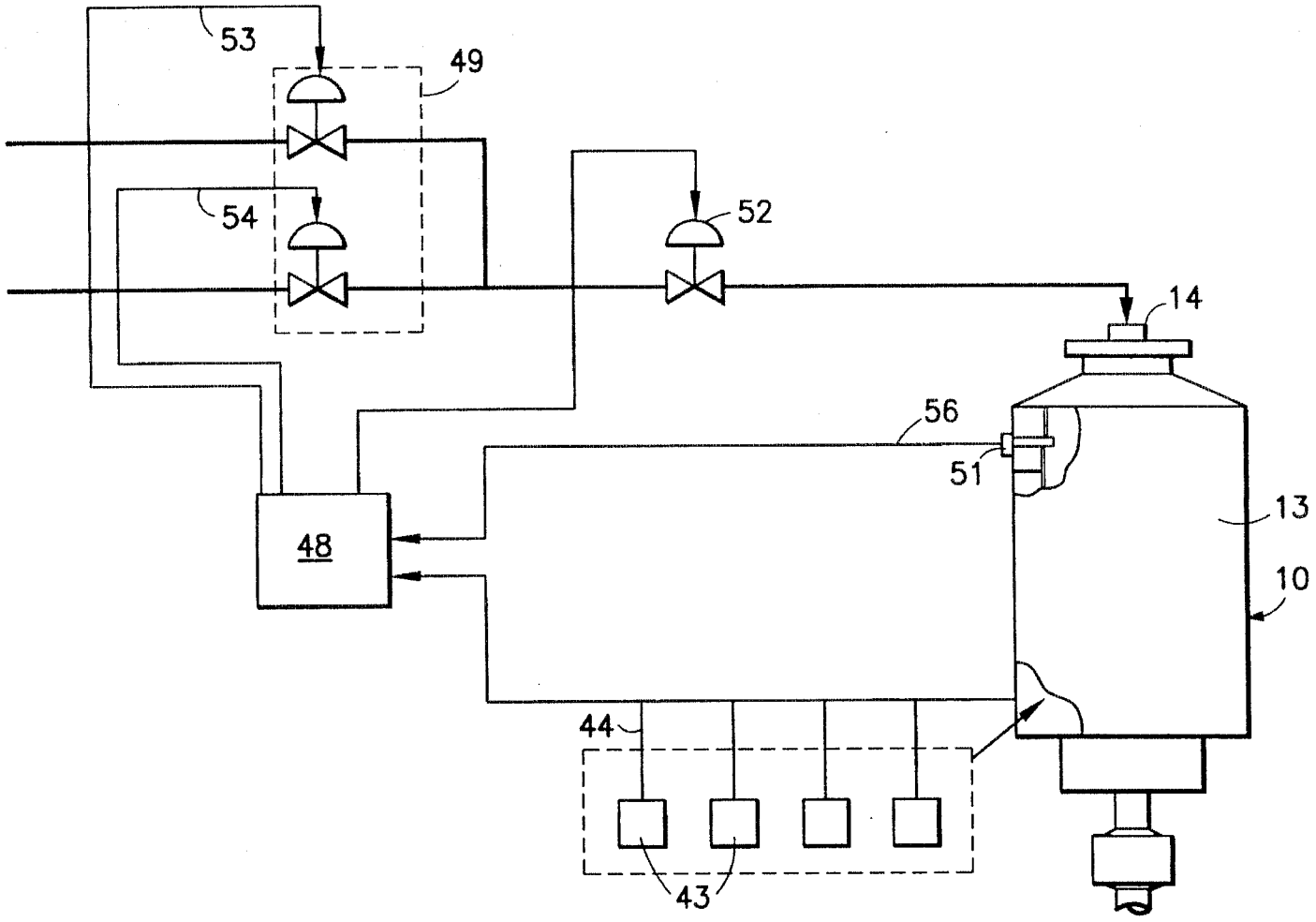
FIG. 3 is a schematic view of the deslagging control system.

Operationally, control of conditions within the gasifier combustion chamber 13 and in particular the latter's prevailing temperature, is relevant toward achieving the desired controlled degree of slag removal. As shown in FIG. 3, for example, one form of fuel composition control chamber 13 is provided with load cells 43 spaced adjacent the underside of the combustion chamber floor 19 (FIGS. 1, 2). In response to downward displacement of floor 19 as the amount of slag progressively accumulates, each load cell will generate an electronic signal reflective of the floor's movement at that particular point in the gasifier's syngas producing process.

The data flow generated by each load cell 43 is forwarded to computer 48. After analyzing of the input data, the computer generates a composite signal. The latter's program compares said data with a standard at which the gasifier is designed to operate and to which the computer is programmed.

The computer determined weight differential between actual slag weight and the programmed operating conditions can be projected onto a screen for viewing by an operator. Alternatively, it can be utilized toward the above noted instantaneous, automatic adjustment of fuel to the combustion chamber's condition.

Again referring to FIG. 3, in one method to maintaining a desired temperature in combustion chamber 13 fuel gases from sources 53 and 54, such as propane and oxygen, are directed to a gas mixer 49. Said mixer is provided with internal adjustable valve means for proportioning inflowing gas to an optimum mixture considered most favorable at that point in the deslagging programmed process. Where a mixing burner is used, the fuel gases can be metered directly to the burner in separate flows. Thereafter, the propane fuel gas and air or oxygen are caused to mix in the combustion chamber to produce the proper deslagging condition.

To properly regulate the process, the temperature in combustion chamber 13 is monitored in any of several ways and through different forms of instrumentation capable of providing the necessary accuracy to effectuate the proper gas mixing and rate of flow.

Combustion chamber 13 can be provided with one or more temperature sensing probes 51 positioned in or about combustion chamber 13, each probe being enclosed in a sheath or the like to be protected from accumulated slag and yet be capable of affording accurate temperature readings. The data provided by temperature sensing probes 51 is fed to computer 48 through a line 56. This data input provides an additional factor in determining the mixture of incoming gases to establish a suitable fuel mix as well as to regulate adjustment of control valve 52. The latter is positioned to regulate the fuel flow rate from mixer 49 to deslagging burner 14.

It is understood that although modifications and variations of the invention can be made without departing from the spirit and scope thereof, only such limitations should be imposed as are indicated in the appended claims.

What is claimed is:

1. A gasifier for the partial oxidation of a carbonaceous fuel mixture in a high temperature atmosphere to provide a hot effluent, including a synthesis gas, said gasifier comprising, a) a housing shell having an upright sidewall portion and a floor portion integrally joined to the upright sidewall portion to form a continuation of the upright sidewall portion, b) a combustion chamber in the housing shell in which the carbonaceous fuel mixture is directed and partially oxidized, said combustion chamber having a refractory wall lining the upright sidewall portion of the housing shell and a refractory floor lining the floor portion of said housing shell, c) a bath section below the floor portion of said housing shell for holding liquid coolant, d) a throat section at the refractory floor of said combustion chamber, said throat section having a throat opening in the refractory floor and the floor portion of said housing shell through which said combustion chamber communicates with said bath section to conduct hot products of said partial oxidation from said combustion chamber into said bath section, e) a deslagging heater at said combustion chamber for melting solidified slag on the refractory wall and the refractory floor of said combustion chamber, said refractory floor being downwardly inclined toward said throat opening to enable the melted slag to flow out of said combustion chamber through said throat opening, f) movement-sensing means provided below the floor portion of said housing shell in said bath section to contact the floor portion of said housing shell in said bath section and deflect with the floor portion of said housing shell to sense deflection of said floor portion of said housing shell due to slag buildup on the refractory wall and the refractory floor of said combustion chamber beyond a predetermined reduced or no slag condition, g) signal-producing means connected to said movement-sensing means for generating a signal corresponding to the deflection of said movement-sensing means to control operation of said deslagging burner to melt the slag buildup on the refractory wall and the refractory floor when said movement-sensing means detects a predetermined deflection of said floor of said housing shell beyond the predetermined reduced or no slag condition.

2. A gasifier as claimed in claim 1 wherein said movement-sensing means include a movement-sensing arm member having one end connected to the upright portion of said housing shell and an opposite end in contact with the floor portion of said housing shell.

3. A gasifier as claimed in claim 2 wherein the opposite end of said movement-sensing arm member is free from connection with the floor portion of said housing shell.

4. A gasifier as claimed in claim 2 wherein the opposite end of said movement-sensing arm member is slidable on said floor portion of said housing shell.

5. A gasifier as claimed in claim 2 wherein said movement-sensing means include a stationary support member immovably joined to the upright portion of said housing shell, in spaced relationship from the movement-sensing arm member and said signal-producing means include a load cell connected to said stationary support member and said movement-sensing arm member.

6. A gasifier as claimed in claim 5 wherein said one end of said movement-sensing arm member is pivoted to the upright portion of said housing shell and the opposite end of said movement-sensing arm member is slidable on the floor portion of said housing shell.

7. A gasifier as claimed in claim 5 wherein said load cell has opposite ends, a first actuating member connecting one end of said load cell to said stationary support member and a second actuating member connecting the opposite end of said load cell to said movement-sensing arm member.

8. A gasifier as claimed in claim 7 wherein said second actuating member is pivotally connected to said movement-sensing arm member.

9. A gasifier as claimed in claim 2 wherein said signal-producing means include a load cell connected to said movement-sensing arm member to detect movement of said movement-sensing arm member.

10. A gasifier as claimed in claim 9 including a plurality of said load cells and said movement-sensing arm members positioned to engage different parts of the floor portion of said housing shell.

* * * * *